US010629111B2

(12) United States Patent
Yamamoto et al.

(10) Patent No.: US 10,629,111 B2
(45) Date of Patent: Apr. 21, 2020

(54) DISPLAY DEVICE

(71) Applicant: SHARP KABUSHIKI KAISHA, Sakai, Osaka (JP)

(72) Inventors: Keiichi Yamamoto, Sakai (JP); Kohhei Tanaka, Sakai (JP); Takayuki Nishiyama, Sakai (JP); Tomohiro Kimura, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/159,613

(22) Filed: Oct. 13, 2018

(65) Prior Publication Data

US 2019/0114955 A1 Apr. 18, 2019

(30) Foreign Application Priority Data

Oct. 13, 2017 (JP) ..... 2017-199499

(51) Int. Cl.
*G09G 3/20* (2006.01)

(52) U.S. Cl.
CPC ..... *G09G 3/2003* (2013.01); *G09G 3/20* (2013.01); *G09G 3/2074* (2013.01); *G09G 3/2085* (2013.01); *G09G 2300/0426* (2013.01); *G09G 2310/0232* (2013.01); *G09G 2310/0264* (2013.01); *G09G 2310/08* (2013.01); *G09G 2340/0414* (2013.01); *G09G 2340/0421* (2013.01)

(58) Field of Classification Search
CPC ..... G09G 3/20; G09G 3/2003; G09G 3/2074; G09G 3/2085; G09G 2300/0426; G09G 2310/0232; G09G 2310/0264; G09G 2310/08; G09G 2340/0414; G09G 2340/0421
See application file for complete search history.

(56) References Cited

U.S. PATENT DOCUMENTS

2007/0165960 A1* 7/2007 Yamada ..... H04N 9/735 382/254
2009/0009454 A1 1/2009 Urisu
2013/0194295 A1* 8/2013 Chan ..... G09G 3/3466 345/619
2015/0293546 A1* 10/2015 Tanaka ..... G02F 1/136227 327/541

FOREIGN PATENT DOCUMENTS

JP H06-003641 A 1/1994
JP H06-282245 A 10/1994
JP 2009-015009 A 1/2009

* cited by examiner

*Primary Examiner* — Nelson M Rosario
(74) *Attorney, Agent, or Firm* — ScienBiziP, P.C.

(57) ABSTRACT

A display device includes: a pixel region that includes a plurality of pixels arranged in matrix; a plurality of lines connected to the pixels, the lines including a plurality of gate lines that extend in a first direction and a plurality of source lines that extend in a second direction; and a driving unit that includes a gate driver that drives the gate lines, and a source driver that drives the source lines. In this display device, the pixels have a uniform size, and the pixel region has a low-resolution area in which m pixels (m is a natural number equal to or more than 2) adjacent in at least one of the first direction and the second direction display an identical gray level at all times.

10 Claims, 15 Drawing Sheets

DISPLAY DEVICE

TECHNICAL FIELD

The present invention relates to a display device, and particularly relates to a display device in which the substantial resolution is partially different in the display screen thereof.

BACKGROUND ART

In recent years, along with the advance of the technology of augmented reality (AR) or virtual reality (VR), technological innovation in head-mounted displays also has been advancing. For contents that require the use of a head-mounted display, an image has to be changed in a manner interlocking with the movement of a user or changes in his/her field of vision, the amount of computation for preparing data to be supplied to the display is enormous. Besides, along with image definition enhancement of head-mounted displays, the number of pixels tends to increase. Moreover, along with the increase of the screen size for pursuing a wider viewing angle, the number of pixels increases. When the number of pixels in a head-mounted display increases in this way, such problems as drastic increase of the required data transfer rate and the amount of computation arise.

As a conventional configuration to solve this problem, for example, a display device in which the pitch of pixels arranged in peripheral parts of the display screen thereof is increased as compared with the pitch in the center part is disclosed in JP-H6 (1994)-282245-A. Further, a display device in which the density of pixels arranged in peripheral parts of a display screen is set smaller than the density of the same in the center part is disclosed in Japanese Patent No. 2795779.

With these configurations, by decreasing the resolution in the peripheral parts as compared with the center part in the display screen, the total number of pixels can be reduced with the definition in the center of the field of vision (the center part) being maintained, whereby the amount of data can be reduced.

In the cases of the above-described conventional configurations, however, the pixel electrode size, the line pitch, etc. are not uniform in the display screen. The control of process conditions at the time of manufacture is therefore complicated, and there is concern about reductions in the efficiency in the manufacture, the non-defective rate, and the like.

In light of these problems, it is an object of the disclosure below to provide a display device in which the substantial resolution is partially different in the display screen while the line pitch is uniform in the display screen.

In order to achieve the above-described object, a display device according to one embodiment includes a pixel region that includes a plurality of pixels arranged in matrix; a plurality of lines connected to the pixels, the lines including a plurality of gate lines that extend in a first direction and a plurality of source lines that extend in a second direction; and a driving unit that includes a gate driver that drives the gate lines, and a source driver that drives the source lines, wherein the pixels have a uniform size, and the pixel region has a low-resolution area in which m pixels (m is a natural number equal to or more than 2) adjacent in at least one of the first direction and the second direction display an identical gray level at all times.

In a display device with the configuration described above, the substantial resolution can be made partially different in the display screen while the line pitch is uniform in the display screen.

BRIEF DESCRIPTION OF DRAWINGS

FIG. 68 is an enlarged schematic diagram illustrating a configuration of a low-resolution area in the display device in Embodiment 4.

MODE FOR CARRYING OUT THE INVENTION

Figure 2:
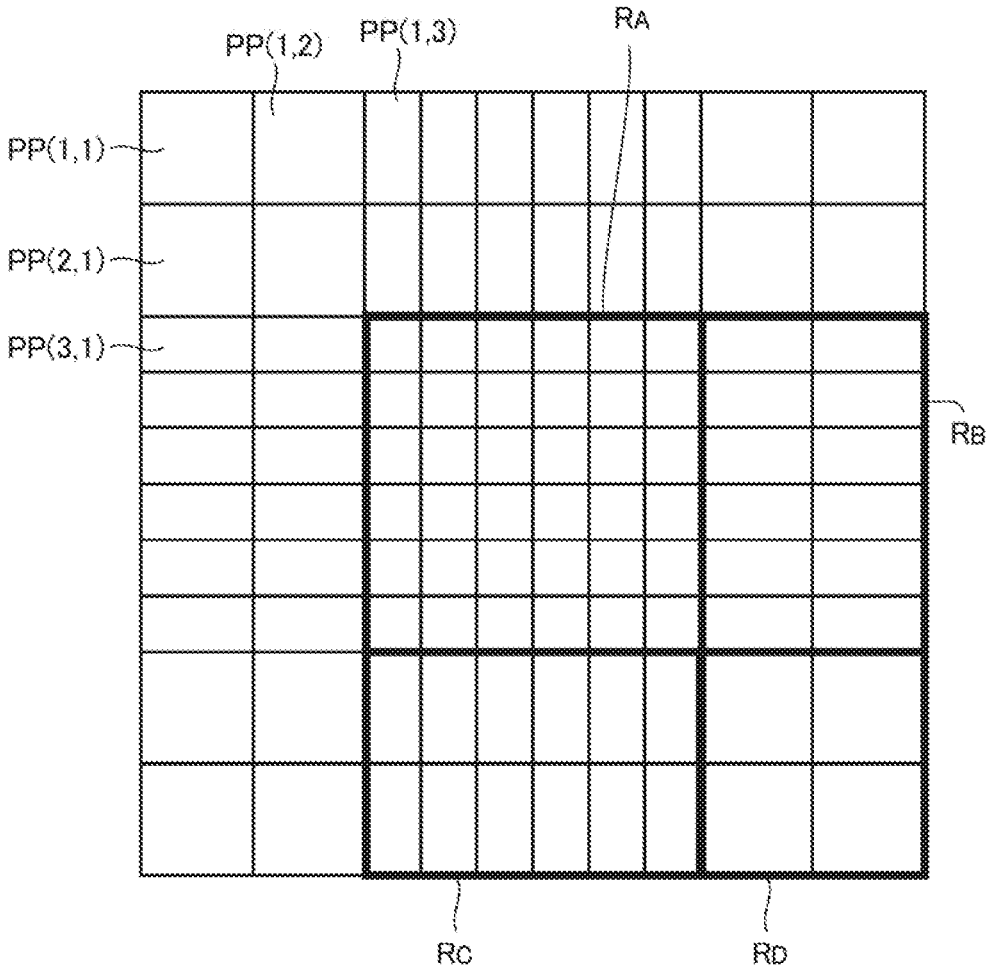
FIG. 2 schematically illustrates a pixel arrangement of the display device in Embodiment 1.

A display device according to the first configuration of the present invention includes:

a pixel region that includes a plurality of pixels arranged in matrix;

a plurality of lines connected to the pixels, the lines including a plurality of gate lines that extend in a first direction and a plurality of source lines that extend in a second direction; and a driving unit that includes a gate driver that drives the gate lines, and a source driver that drives the source lines, wherein the pixels have a uniform size, and the pixel region has a low-resolution area in which m pixels (m is a natural number equal to or more than 2) adjacent in at least one of the first direction and the second direction display an identical gray level at all times.

According to the above-described first configuration, the pixels in the pixel region have a uniform size, but the pixel region includes a low-resolution area in which m pixels (m is a natural number equal to or more than 2) adjacent in at least one of the first direction and the second direction display an identical gray level at all times. In other words, the low-resolution area is such an area that m pixels (m is a natural number equal to or more than 2) adjacent in at least one of the first direction and the second direction display an identical gray level at all times, thereby causing the substantial resolution in at least one of the first direction and the second direction to be seen as being 1/m to human eyes. Here, the "low-resolution area" means an area having a resolution relatively low with respect to an area that exhibits a resolution equivalent to the number of pixels. In this way, by configuring the pixel region so that it includes a low-resolution area in part, the amount of data can be reduced as compared with the total number of pixels in the pixel region. Further, since the pixels in the pixel region have a uniform size, as compared with the conventional configuration in which the pixel electrode size, the line pitch, and the like are not uniform, the following advantages can be achieved: the control of process conditions in the manufacture is not complicated, and there is no concern about decreases in the efficiency in the manufacture, the non-defective rate, and the like.

The display device according to the second configuration has the first configuration further characterized in that:

in the low-resolution area, m lines at least either among the gate lines or among the source lines are connected to one terminal of the driving unit.

According to the second configuration, in the low-resolution area, a connection of at least either the gate lines or the source lines to the driving unit is in such a manner that m lines are connected to one terminal of the driving unit. With this configuration, in the low-resolution area, the substantial resolution in the source line extending direction or in the gate line extending direction can be reduced to 1/m. As a result, the amount of data can be reduced as compared with the actual number of the pixels.

The display device according to the third configuration has the second configuration further characterized in that:

the low-resolution area includes an area in which a connection of the gate lines to the driving unit is in such a manner that m lines are connected to one terminal of the driving unit, and a length of a period while the gate driver outputs a selection signal to the terminal to which the m gate lines are connected is m times a length of a period while the gate driver outputs the selection signal to a terminal to which one gate line is connected.

This third configuration makes it possible to reduce the number of the substantial pixels to 1/m in the low-resolution area. To the m gate lines connected to one terminal of the gate driver, the selection signal is applied simultaneously. By increasing the length of this selection period to m times the usual length, the period while the pixels connected to these m gate lines are charged is made sufficiently long. By so doing, insufficient charging of the pixels can be prevented, whereby the intended gray level can be displayed surely.

The display device according to the fourth configuration has the second or third configuration further characterized in that:

the pixels correspond to a plurality of colors, respectively, and in the low-resolution area, at least a connection of the source lines is in such a manner that m lines connected to the pixels of the same colors are connected to one terminal of the driving unit.

This configuration makes it possible to reduce the number of substantial pixels in the low-resolution area to 1/m in a display device having pixels of a plurality of colors as well.

The display device according to the fifth configuration has the fourth configuration further characterized in that:

the pixels correspond to n colors (n is a natural number equal to or more than 3), in a high-resolution area that is the rest of the low-resolution area in the pixel region, the pixels of the n colors are periodically arranged along a direction in which the gate lines extend, and in the low-resolution area, the pixels of the n colors are arranged periodically by m pixels for each color along the direction in which the gate lines extend.

According to this configuration, in the low-resolution area, the pixels of the n colors are arranged periodically by m pixels for each color along the gate lines extending direction. Thereby, the source lines connected to m pixels (i.e., the pixels of the same color) adjacent along the gate line extending direction can be connected to one terminal of the source driver. With this configuration, the source lines do not intersect with one another in the low-resolution area, which makes it possible to prevent the source lines from being coupled. As a result, the deterioration of the display quality in the low-resolution area can be prevented.

The display device according to the sixth configuration has any one of the second to fifth configurations further characterized in that:

the low-resolution area includes an area where a connection of the source lines and the gate lines to the driving unit is in such a manner that m source lines are connected to one terminal of the driving unit, and one gate lines is connected to one terminal of the driving unit, and in this area, the pixels connected to two or more adjacent ones of the gate lines are connected with each other.

According to this configuration, in the low-resolution area, in an area where m lines among the source lines are connected to one terminal of the driving unit, and one of the gate lines is connected to one terminal of the driving unit, the pixels connected to two or more adjacent ones of the gate lines are connected. By so doing, the pixels in this area are charged over substantially two horizontal periods. This makes it possible to sufficiently charge the pixels in this area, thereby preventing the deterioration of the display quality.

The display device according to the seventh configuration has any one of the first to fourth configurations further characterized in that:

the pixels correspond to n colors (n is a natural number equal to or more than 3), the pixels of the n colors are periodically arranged along a direction in which the source lines extend, and the low-resolution area includes an area where a connection of the source lines to the driving unit is in such a manner that m lines are connected to one terminal of the driving unit.

With this configuration, the source lines do not intersect with one another in the low-resolution area, which makes it possible to prevent the source lines from being coupled. As a result, the deterioration of the display quality in the low-resolution area can be prevented.

The display device according to the eighth configuration has the first configuration further characterized in further including:

switching elements that are connected to the gate lines and the source lines and drive the pixels, wherein, in the low-resolution area, a connection of the pixels and the switching elements is in such a manner that m pixels that are adjacent along a direction in which the gate lines extend are connected with each other, and are driven by one switching element.

This configuration makes it possible to set the substantial resolution in the gate line extending direction in the low-resolution area to 1/m. Further, this makes it possible to reduce the number of the source lines in the low-resolution area to 1/m. This makes it possible to reduce loads on the source drivers, thereby improving the display quality in the low-resolution area.

The display device according to the ninth configuration has the eighth configuration further characterized in that:

between the m pixels, a dummy line that is formed in parallel with the source lines, and is not connected to the driving unit.

According to this configuration, a dummy line is provided in the low-resolution area, in a portion thereof where no source line is present, which makes it possible to suppress the screen door effect. Further, there is another advantage that by forming the dummy line with the same material in the same step as the source lines, the processing conditions in the manufacture can be made uniform in the pixel region.

The display device according to the tenth configuration has any one of the first to ninth configurations further characterized in that:

the source driver includes a plurality of driver circuits that have different output capabilities, and among the driver circuits, the driver circuit that drives the pixels in the low-resolution area has a higher output capability than the other driver circuits.

According to this configuration, the number of pixels to be driven is substantially larger in the low-resolution area, whereby loads on the driver increase. The output capability of the driver that drives the pixels in the low-resolution area is set higher than the output capability of another driver circuit, which makes it possible to compensate the increase in the loads. This makes it possible to improve the display quality in the low-resolution area.

SPECIFIC EMBODIMENT

The following description describes embodiments of the present invention in detail, while referring to the drawings. Identical or equivalent parts in the drawings are denoted by the same reference numerals, and the descriptions of the same are not repeated. To make the description easy to understand, in the drawings referred to hereinafter, the configurations are simply illustrated or schematically illustrated, or the illustration of a part of constituent members is omitted. Further, the dimension ratios of the constituent members illustrated in the drawings do not necessarily indicate the real dimension ratios.

Embodiment 1

Figure 1:
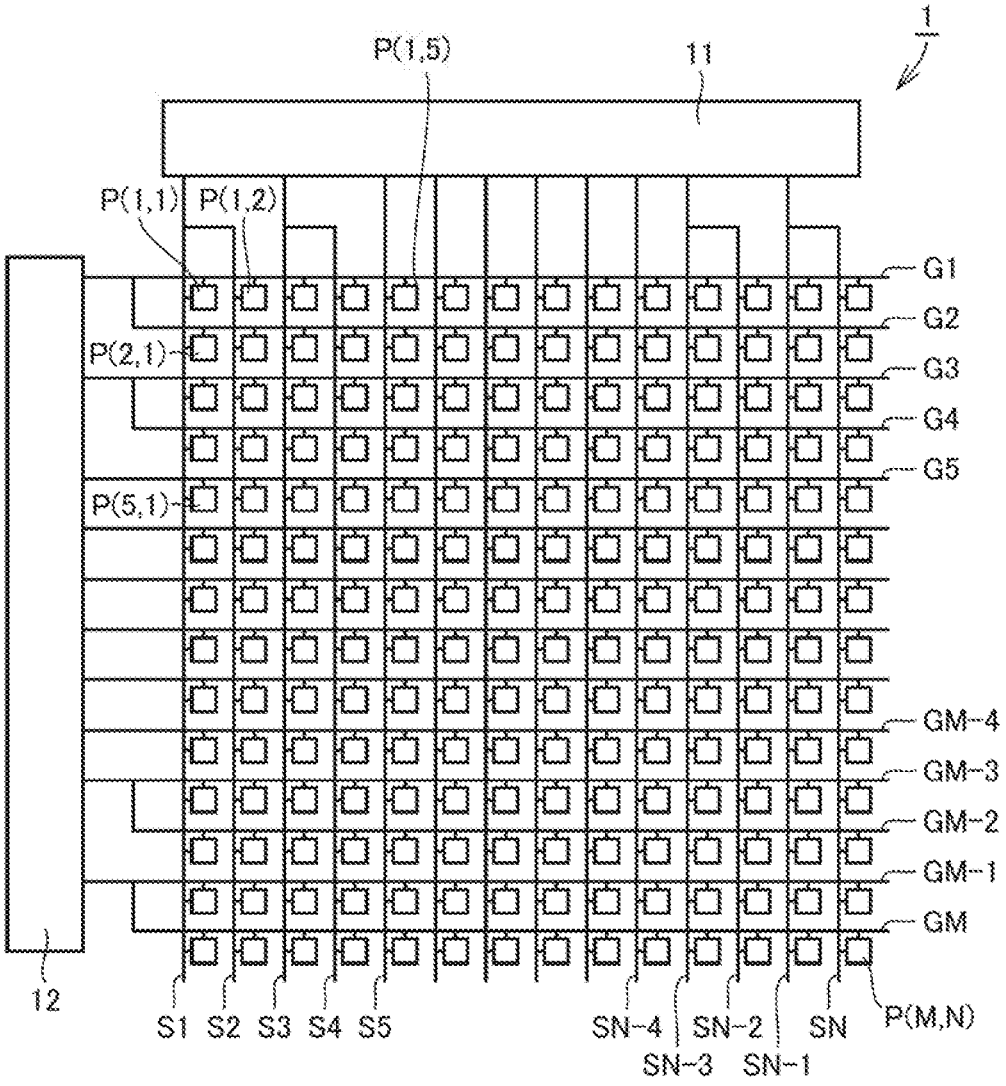
FIG. 1 schematically illustrates a schematic configuration of a display device in Embodiment 1.

FIG. 1 schematically illustrates a schematic configuration of a display device in the present embodiment. A display device 1 can be formed with, for example, a liquid crystal display. Besides, the display device 1 can be implemented as a head-mounted display.

As illustrated in FIG. 1, the display device 1 includes M gate lines G1 to GM, and N source lines S1 to SN. The gate lines G1 to GM are arranged in parallel with one another at equal intervals. The source lines S1 to SN are arranged in parallel with one another at equal intervals. Hereinafter, when the gate lines are generally referred to, without being distinguished from one another, each is referred to as a "gate line G". This applies to the source lines S as well. The gate lines G and the source lines S are arranged so as to intersect at right angles.

The display device 1 includes a gate driver 12 that drives the gate lines G and a source driver 11 that supplies data signals to the source lines S. The gate driver 12 selects the gate lines G1 to GM in a predetermined order, and applies a selection signal thereto. The source driver 11 performs writing to pixels connected to the gate line G to which the selection signal is being applied. In other words, the source driver 11 supplies, to the source line S, data signals corresponding to gray levels to be displayed on the pixels.

In the vicinity of each of the points of intersection between the gate lines G and the source lines S, a pixel electrode P is formed. The pixel electrode P is connected to the gate line G and the source line S via switching elements (not shown) such as TFTs. Hereinafter, a pixel electrode P connected to the gate line Gm and the source line Sn is denoted by P(m, n). The pixel electrodes P are formed so as to have a uniform size.

As illustrated in FIG. 1, in the display device 1, the gate line G1 and the gate line G2 are connected to the same terminal of the gate driver 12. So do the gate lines G3 and G4, the gate lines GM-3 and GM-2, and the gate lines GM-1 and GM. The gate lines G5 to GM-4 are connected to the terminals of the gate driver 12 in one-to-one correspondence. A pair of the two gate lines that are connected to one and the same terminal of the gate driver 12 in this way are referred to as "pair gate lines" hereinafter.

Further, the source line S1 and the source line S2 are connected to one and the same terminal of the source driver 11. So do the source lines S3 and S4, the source lines SN-3 and SN-2, and the source lines SN-1 and SN. The source lines S5 to SN-4 are connected to the terminals of the source driver 11 in one-to-one correspondence. A pair of the two source lines that are connected to one and the same terminal of the source driver 11 in this way are referred to as "pair source lines" hereinafter.

The pair gate lines G1 and G2 are selected simultaneously by the gate driver 12, and the selection signal is simultaneously applied to them. This applies to the pair gate lines G3 and G4, the pair gate lines GM-3 and GM-2, and the pair gate lines GM-1 and GM. If a period while a selection signal is applied to each of the gate lines G5 to GM-4 is assumed to be one clock unit, then, a selection signal of two clock units is applied to the gate lines G1 and G2. In other words, a selection frequency for the pair gate lines G1 and G2, the pair gate lines G3 and G4, the pair gate lines GM-3 and GM-2, and the pair gate lines GM-1 and GM is ½ of a selection frequency for the gate lines G5 to GM-4, which are selected one by one.

Further, to the pair source lines S1 and S2, the same data signal is simultaneously supplied from the source driver 11. This applies to the pair source lines S3 and S4, the pair source lines SN-3 and SN-2, and the pair source lines SN-1 and SN.

With such driving of the gate lines and the source lines, a data signal of the same gray level is simultaneously written in the four pixel electrodes arranged at points of intersection between the pair gate lines G1, G2 and the pair source lines S1, S2 in the display device 1, that is, the pixel electrodes P(1, 1), P(1, 2), P(2, 1), and P(2, 2). As a result, pixels of these four pixel electrodes simultaneously display the same gray level. This applies to the pixel electrodes P(3, 1), P(3, 2), P(4, 1), and P(4, 2), which are arranged at points of intersection between the pair gate lines G3, G4 and the pair source lines S1, S2. This also applies to the pixel electrodes P(1, 3), P(1, 4), P(2, 3), and P(2, 4), which are arranged at points of intersection between the pair gate lines G1, G2 and the pair source lines S3, S4. Further, this also applies to the pixel electrodes P(3, 3), P(3, 4), P(4, 3), and P(4, 4), which are arranged at points of intersection between the pair gate lines G3, G4 and the pair source lines S3, S4.

Further, regarding the pixel electrodes arranged at points of intersection between the pair gate lines G1, G2 and the source lines S5 to SN-4, two pixel electrodes adjacent in the vertical direction (in the source line S extending direction) are selected simultaneously, and a data signal of the same gray level is written therein simultaneously. This causes pixels of these two pixel electrodes to display the same gray level simultaneously.

Further, regarding the pixel electrodes arranged at point of intersection between the gate lines G5 to GM-4 and the pair source lines S1 and S2, two pixel electrodes in the horizontal direction (in the gate line G extending direction) are selected simultaneously, and a data signal of the same gray level is written therein simultaneously. This causes pixels of these two pixel electrodes to display the same gray level simultaneously.

Since the four pixels at the points of intersection between the pair gate lines G and the pair source lines S display the same gray level simultaneously as described above, these are recognized by human sense of vision as one large pixel whose size is equivalent to the size of four pixels in total, which are two pixels in the gate line G extending direction by two pixels in the source line S extending direction. Besides, since two pixels at points of intersection between the pair gate lines G and the source line S display the same gray level simultaneously, these are recognized by human sense of vision as one large pixel whose size is equivalent to the size of two pixels in the source line S extending direction. Likewise, since two pixels at points of intersection between the gate line G and the pair source lines S display the same gray level simultaneously, these are recognized by human sense of vision as one large pixel whose size is equivalent to the size of two pixels in the gate line G extending direction.

For example, when the display device 1 illustrated in FIG. 1 is driven, the pixel electrodes P(1, 1), P(1, 2), P(2, 1), and P(2, 2), which simultaneously display the same gray level, are recognized as a pseudo pixel PP(1, 1) having a size equivalent to four pixels, as illustrated in FIG. 2. Likewise, the pixel electrodes P(3, 1), P(3, 2), P(4, 1), and P(4, 2) are recognized as a pseudo pixel PP(2, 1) having a size equivalent to four pixels. Further, the pixel electrodes P(1, 3), P(1, 4), P(2, 3), and P(2, 4) are recognized as a pseudo pixel PP(1, 2) having a size equivalent to four pixels.

Still further, the pixel electrodes P(5, 1) and P(5, 2), which simultaneously display the same gray level, are recognized as a pseudo pixel PP(3, 1) having a size equivalent to two pixels in the horizontal direction. Still further, the pixel electrodes P(1, 5) and P(2, 5), which simultaneously display the same gray level, are recognized as a pseudo pixel PP(1, 3) having a size equivalent to two pixels in the vertical direction.

As a result, in the display screen of the display device 1, as illustrated in FIG. 2, the center part (area $R_A$) has a resolution corresponding to the actual number of the pixels, and in the peripheral parts, there are areas (low-resolution areas) that include large pixels each of which is equivalent to two pixels in at least one of the vertical direction (the source line S extending direction) and the horizontal direction (the gate line G extending direction). For example, in FIG. 2, as compared with the area $R_A$, the resolution in the horizontal direction in the area $R_B$ is ½, the resolution in the vertical direction in the area $R_C$ is ½, and both of the resolution in the vertical direction and the resolution in the horizontal direction in the area $R_D$ are ½. Here, the area $R_A$ is referred to as a high-resolution area, and the areas $R_B$, $R_C$, $R_D$ and the like around the area $R_A$ are referred to as low-resolution areas, meaning that these areas have resolutions relatively low with respect to the resolution in the area $R_A$.

As is described above, according to the present embodiment, a part of (peripheral parts) of the display screen can be low-resolution areas, while the line pitches of the gate lines G and the source lines S are made uniform, and further, the sizes of the pixel electrodes P are made uniform. As compared with the conventional configuration having different line pitches and different actual pixel sizes, therefore, the control of process conditions in the manufacture is easier, whereby reductions in the efficiency in the manufacture, the non-defective rate, and the like are hardly caused. Further, since the low-resolution areas are provided, the amount of data for composing one screen is decreased, the data transfer rate can be reduced, and the amount of computation on the host side can be reduced.

Still further, in the areas including the pair gate lines such as the areas $R_C$ and $R_D$, since two gate lines are maintained in the selected state over two horizontal periods, the charging of the pixels connected to the pair gate lines can be performed over the two horizontal periods. In this way, there is also an advantage that a long period for charging the pixels can be ensured.

In order to make the description understood easily. FIG. 1 illustrates an exemplary configuration in which two pairs of the pair gate lines and two pairs of the pair source lines are provided at the ends in the vertical and horizontal directions of the display screen, but the number of the pair gate lines and the pair source lines are arbitrary. Further, in the example illustrated in FIG. 1, the center part of the display screen is an area where display is performed with the same number of pixels as that of the actual number of the pixel electrodes (the high-resolution area), and the low-resolution areas are symmetrically provided at ends in the vertical and horizontal directions of the center part, but the positional relationship of the high-resolution and low-resolution areas is arbitrary. This applies to the other embodiments described below.

Further, the present embodiment is described with reference to an exemplary configuration in which two source lines or two gate lines are connected to one terminal of the driver. The configuration, however, can be such that three or more source lines or gate lines are connected to one terminal.

Embodiment 2

The following description describes Embodiment 2. Constituent members having the same functions as those in Embodiment 1 are denoted by the same reference symbols, and detailed descriptions of the same are omitted. This applies to the other embodiments described below.

In the present embodiment, the display screen includes pixels of three colors of red (R), green (G), and blue (B) that are regularly arranged, thereby being capable of performing color display. In order to cause the pixels to be displayed in these colors, for example, color filters can be used. Since the pixel configuration using color filters is known, detailed descriptions of the same are omitted. In the present embodiment, the pixels of R, G, and B are arrayed in stripe. In other words, all of the pixels connected to one source line display the same color, and the pixels of R, G, and B are periodically arranged along the gate line extending direction.

The following description describes an aspect of display of the pixels in the present embodiment, while referring to FIGS. 3A to 3D.

Figure 3A:
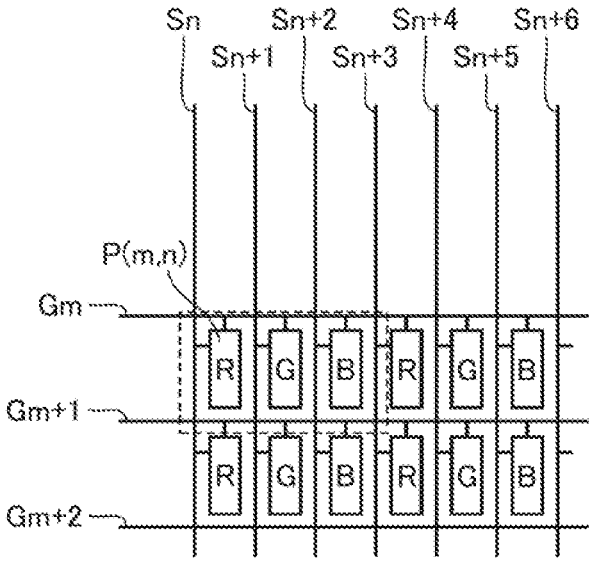
FIG. 3A is an enlarged schematic diagram illustrating a configuration of a high-resolution area in a display device in Embodiment 2.

FIG. 3A is an enlarged schematic diagram illustrating a configuration of a part of an area equivalent to the area $R_A$ in FIG. 2 (a high-resolution area) in a display device in the present embodiment. As illustrated in FIG. 3A, in the high-resolution area, each pixel is driven by one gate line G and one source line S, and three pixels surrounded by a broken line composes one picture element.

Figure 3B:
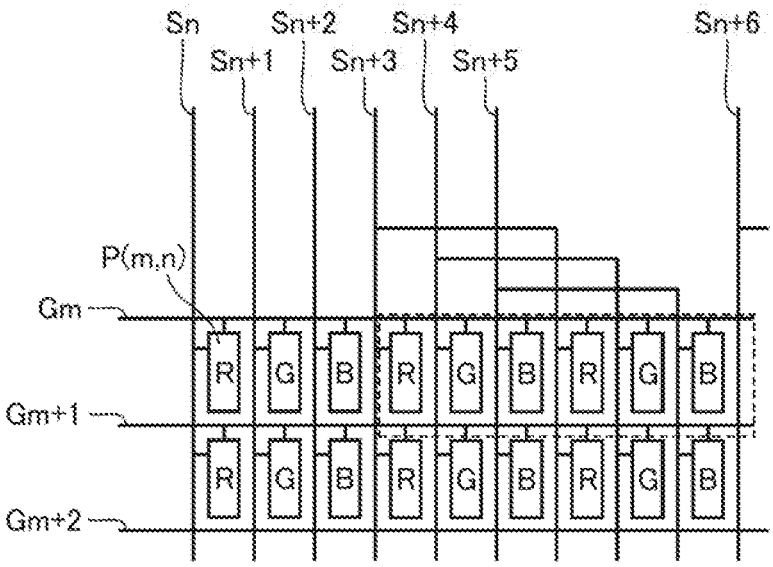
FIG. 3B is an enlarged schematic diagram illustrating a configuration of a low-resolution area in the display device in Embodiment 2.

On the other hand, as illustrated in FIG. 3B, in the area equivalent to the area $R_B$ in FIG. 2 (a low-resolution area), the pair source lines S are connected to the pixels of the same color. This causes two picture elements composed of six pixels surrounded by a broken line to display the same gray level simultaneously in the area $R_B$. In other words, two picture cells each of which is composed of three sub-pixels simultaneously display the same gray level.

Figure 3C:
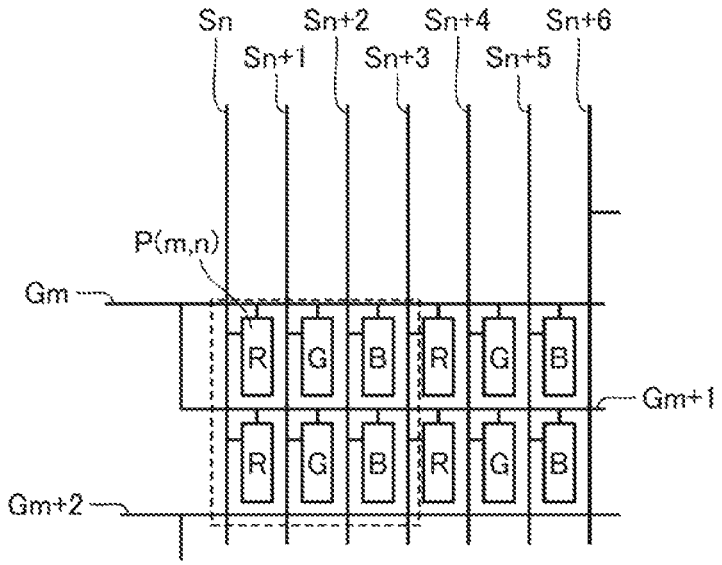
FIG. 3C is an enlarged schematic diagram illustrating a configuration of a low-resolution area in the display device in Embodiment 2.

Further, as illustrated in FIG. 3C, in the area equivalent to the area $R_C$ in FIG. 2 (a low-resolution area), since two rows are simultaneously selected by the pair gate lines G, two picture elements composed of six pixels surrounded by a broken line simultaneously display the same gray level. In other words, two picture cells each of which is composed of three sub-pixels simultaneously display the same gray level.

Figure 3D:
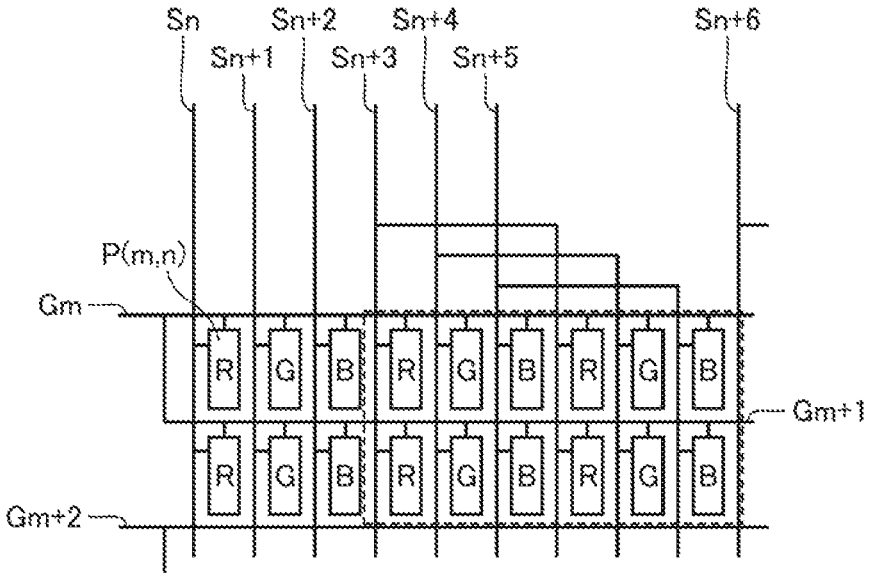
FIG. 3D is an enlarged schematic diagram illustrating a configuration of a low-resolution area in the display device in Embodiment 2.

Further, as illustrated in FIG. 3D, in the area equivalent to the area $R_D$ in FIG. 2 (a low-resolution area), two rows are simultaneously selected by the pair gate lines G and the pair source lines S are connected to the pixels of the same color. This causes four picture elements composed of twelve pixels surrounded by a broken line to simultaneously display the same gray level. In other words, four picture cells each of which is composed of three sub-pixels simultaneously display the same gray level.

As described above, according to Embodiment 2, in a case where color display is performed with the pixels of three colors of R, G, and B as well, a part of (peripheral parts) of the display screen can be low-resolution areas, while the line pitches of the gate lines G and the source lines S are made uniform, and further, the sizes of the pixel electrodes P are made uniform. As compared with the conventional configuration having different line pitches and different actual pixel sizes, therefore, the control of process conditions in the manufacture is easier, whereby reductions in the efficiency in the manufacture, the non-defective rate, and the like are hardly caused. Further, since the low-resolution areas are provided, the amount of data for composing one screen is decreased, the data transfer rate can be reduced, and the amount of computation on the host side can be reduced.

As the present embodiment, an example is described in which one picture element is composed of pixels of three colors of R, G, and B, but the colors that compose one picture element and the number of pixels that compose the same are not limited to those; they are arbitrary. This applies to the other embodiments described below.

Embodiment 3

The following description describes Embodiment 3 while referring to FIGS. 4A to 4D.

Figure 4A:
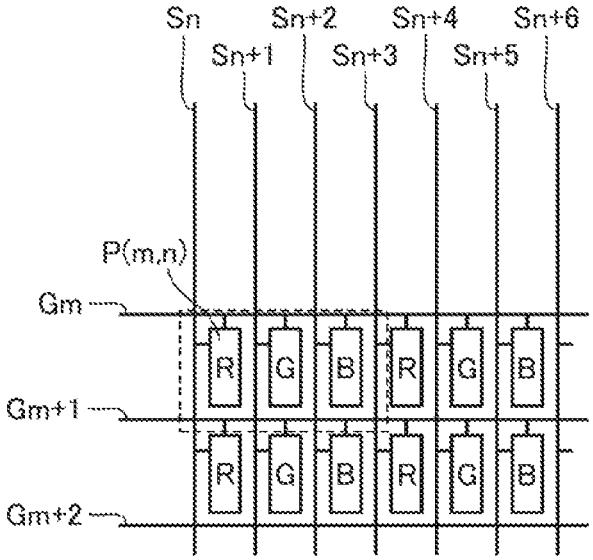
FIG. 4A is an enlarged schematic diagram illustrating a configuration of a high-resolution area in a display device in Embodiment 3.
Figure 4B:
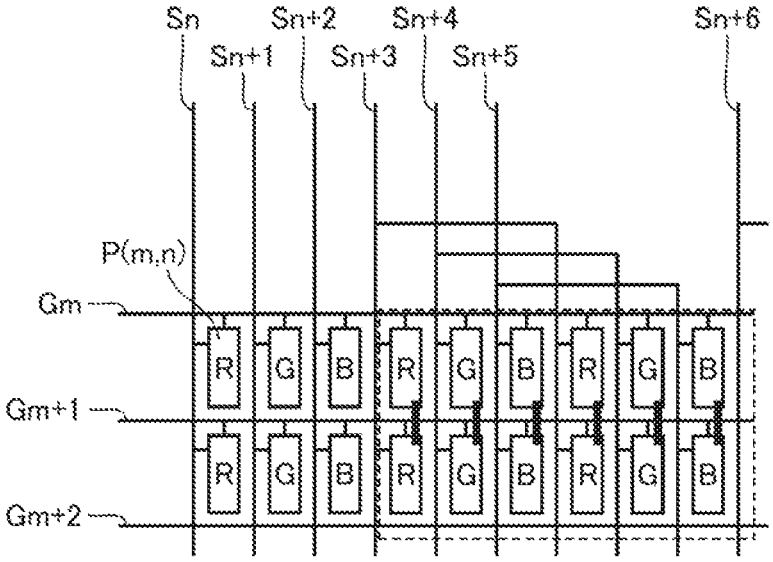
FIG. 4B is an enlarged schematic diagram illustrating a configuration of a low-resolution area in the display device in Embodiment 3.
Figure 4C:
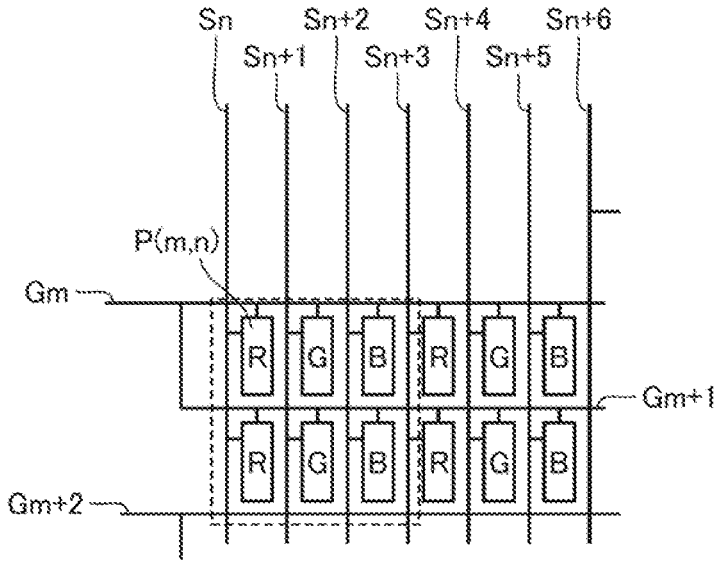
FIG. 4C is an enlarged schematic diagram illustrating a configuration of a low-resolution area in the display device in Embodiment 3.
Figure 4D:
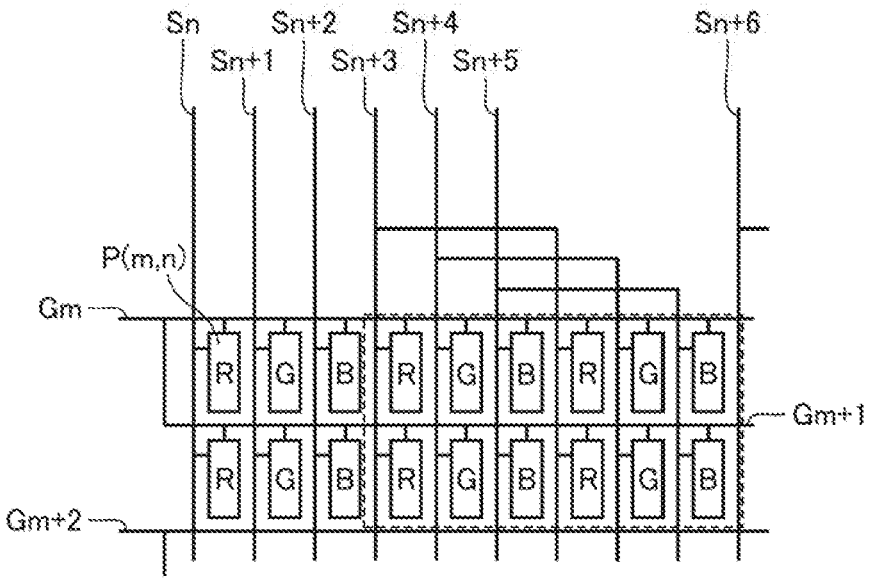
FIG. 4D is an enlarged schematic diagram illustrating a configuration of a low-resolution area in the display device in Embodiment 3.

In the display device according to Embodiment 3, the configurations of the areas $R_A$, $R_C$, and $R_D$ are the same as those in Embodiment 2, as illustrated in FIGS. 4A, 4C, and 4D. As illustrated in FIG. 4B, however, the configuration of Embodiment 3 is different from Embodiment 2 in that two pixels adjacent in the vertical direction (the source line extending direction) are connected in the area $R_B$. As the two pixels adjacent in the vertical direction are connected in this way, these two pixels are subjected to writing over substantially two horizontal periods. This causes a longer pixel charging period to be ensured in the area $R_B$, thereby providing an advantage that the deterioration of the display quality can be prevented.

Figure 5A:
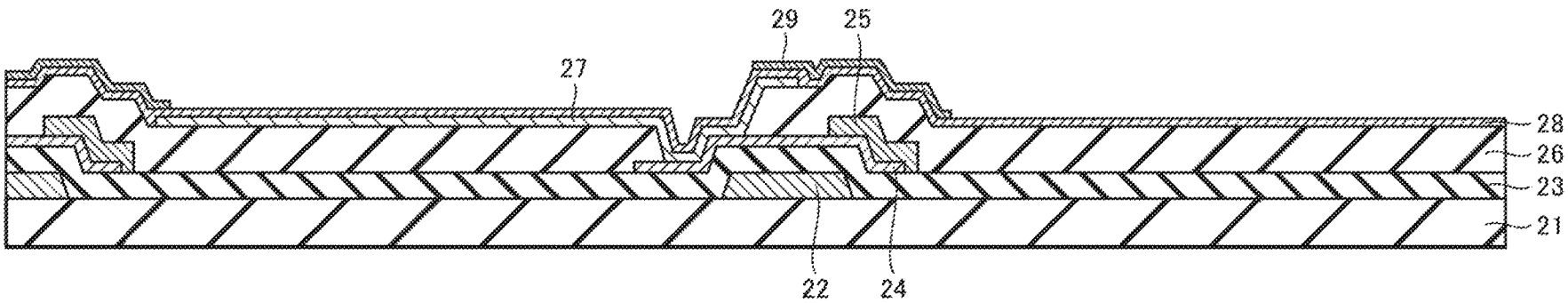
FIG. 5A is a cross-sectional view illustrating an exemplary cross-sectional structure of the display device in Embodiment 3.
Figure 5B:
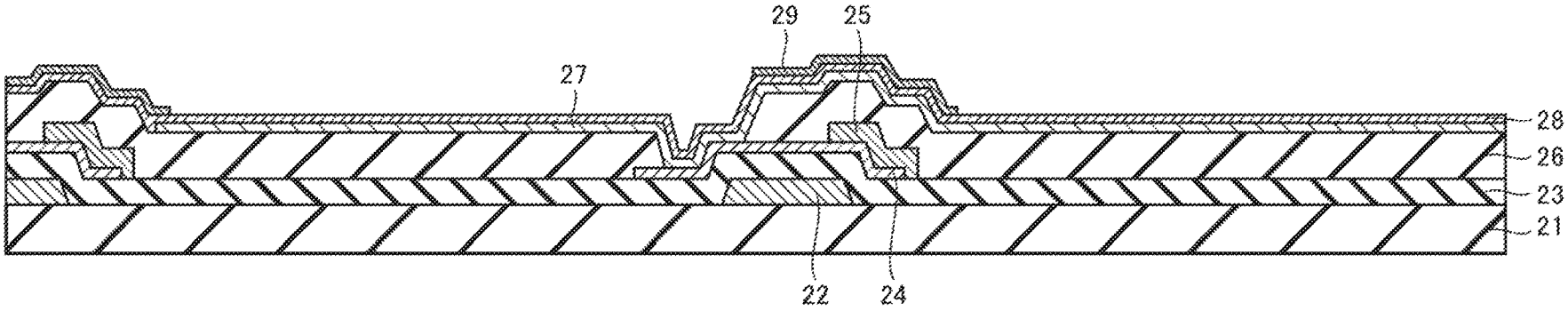
FIG. 5B is a cross-sectional view illustrating another exemplary cross-sectional structure of the display device in Embodiment 3.

FIG. 5A is a cross-sectional view taken along line A-A in FIG. 4A. FIG. 5B is a cross-sectional view taken along line B-B in FIG. 4B. FIGS. 5A and 5B are cross-sectional view of an active matrix substrate in a case where the display device is formed as a horizontally aligned liquid crystal display device. In FIGS. 5A and 5B, "21" denotes a glass substrate, "22" denotes a gate electrode, "23" denotes a first insulating film, "24" denotes a semiconductor layer, "25" denotes a source electrode, "26" denotes a second insulating film, "27" denotes an ITO film composing the pixel electrode. "28" denotes a third insulating film, and "29" denotes a common electrode that, in pair with the pixel electrode, applies a voltage to the liquid crystal. As the configurations of these are known, detailed descriptions of the same are omitted. As is clear from FIGS. 5A and 5B, in order to connect pixels adjacent in the vertical direction, the patterning of the ITO film 27 composing the pixel electrode P may be performed so that the ITO film 27 is provided over two pixels continuously, and no additional step is required.

Embodiment 4

The following description describes Embodiment 4 while referring to FIGS. 6A to 6D.

The display device according to Embodiment 4 is different from Embodiment 2 in that, in the low-resolution area where the pair source lines S are arranged, the order in which the pixels of R, G, and B are arrayed is different. Incidentally, the pixel arrangement in the area in which the source lines S are connected to the terminals of the source driver 11 in one-to-one correspondence is identical to that in Embodiment 2 (see FIGS. 6A and 6C).

Figure 6C:
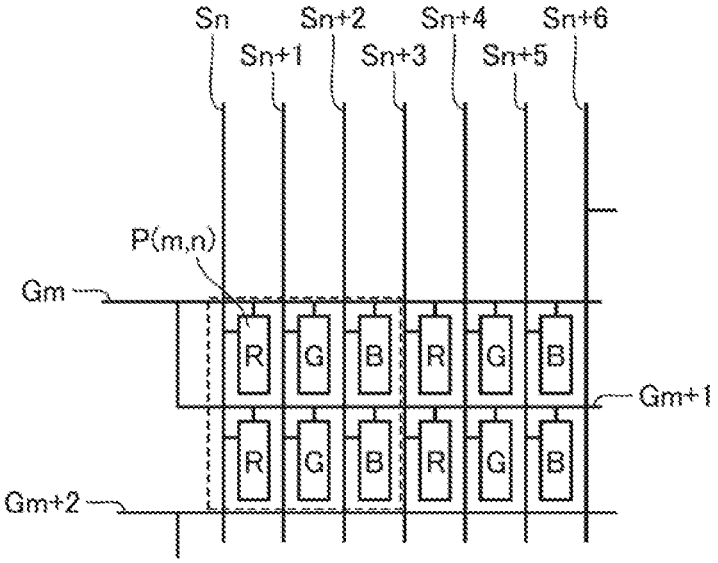
FIG. 6C is an enlarged schematic diagram illustrating a configuration of a low-resolution area in the display device in Embodiment 4.
Figure 6D:
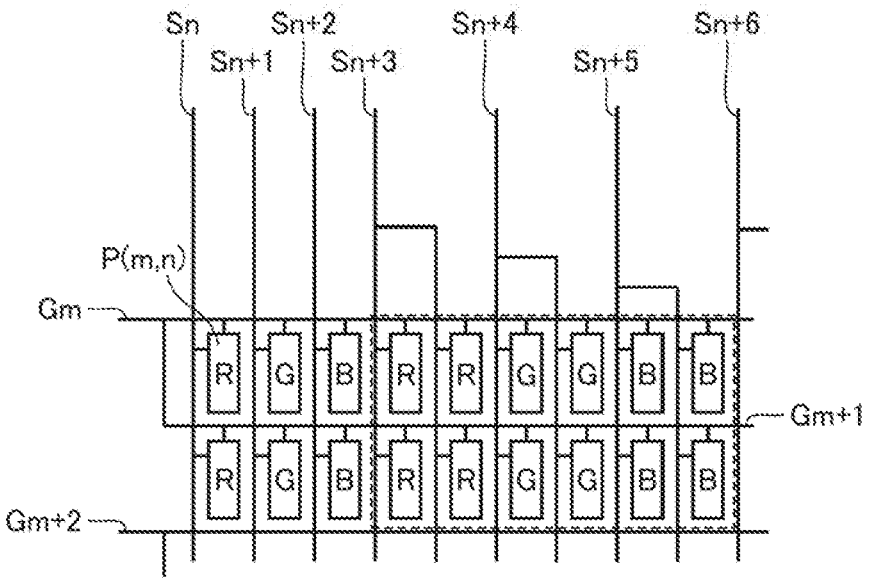
FIG. 6D is an enlarged schematic diagram illustrating a configuration of a low-resolution area in the display device in Embodiment 4.
Figure 6A:
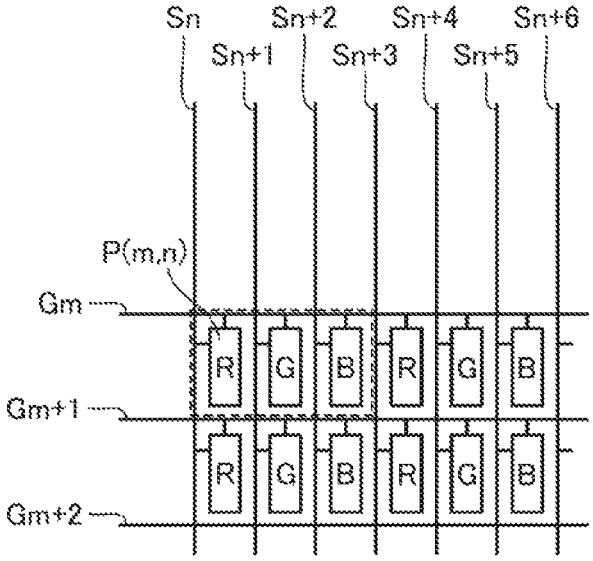
FIG. 6A is an enlarged schematic diagram illustrating a configuration of a high-resolution area in a display device in Embodiment 4.
Figure 6B:
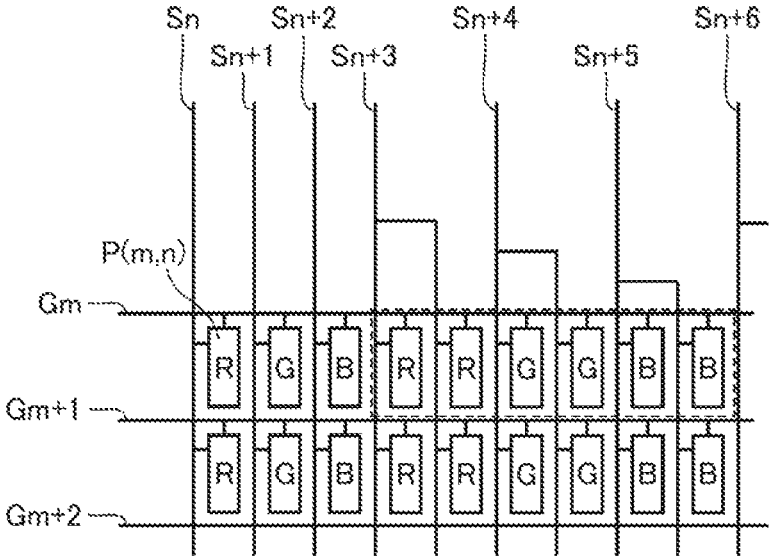

In the present embodiment, as illustrated in FIGS. 6B and 6D, the pixels of R, G, and B are periodically arrayed in the order of R, R, G, G, B, and B along the gate line G extending direction in the areas $R_B$ and $R_D$ where the pair source lines S are arranged. Two adjacent ones of the source lines S connected to the pixels of the same color compose pair source lines.

In this way, the pixels of respective colors of R, G, and B are arranged in such a manner that each color is repeated the same number of times as the number of the source lines S composing the pair source lines S (two in this case), whereby no intersection between the source lines occurs. If the source lines intersect, the coupling of the writing voltages with respect to the pixels occurs, but the present embodiment has an advantage that such coupling does not occur.

Embodiment 5

The following description describes Embodiment 5, while referring to FIGS. 7A to 7D.

Figure 7A:
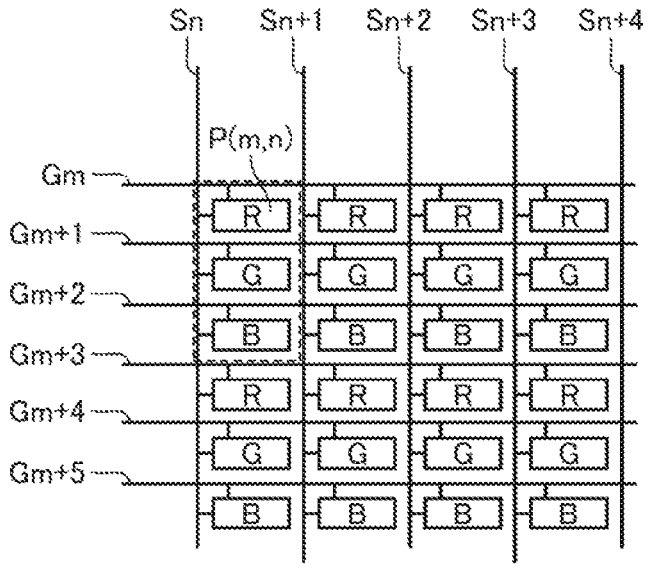
FIG. 7A is an enlarged schematic diagram illustrating a configuration of a high-resolution area in a display device in Embodiment 5.
Figure 7B:
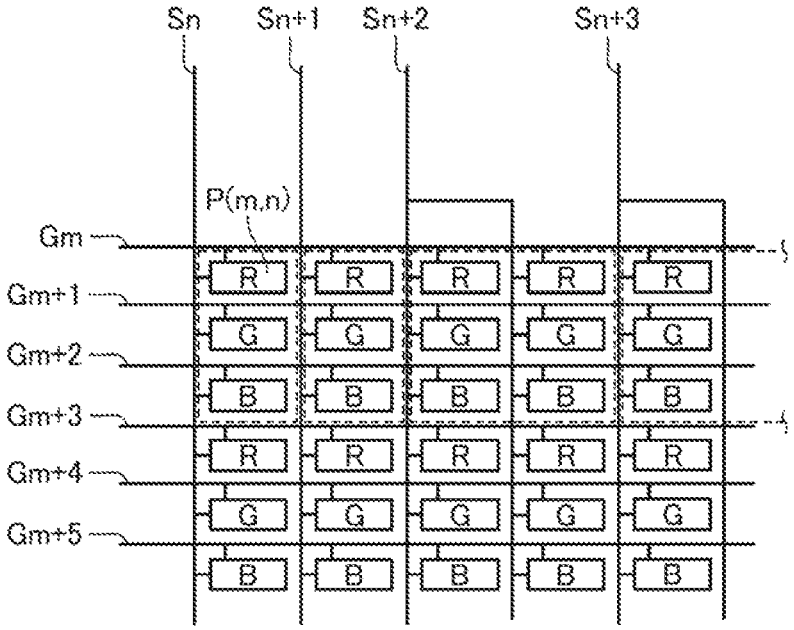
FIG. 7B is an enlarged schematic diagram illustrating a configuration of a low-resolution area in the display device in Embodiment 5.
Figure 7C:
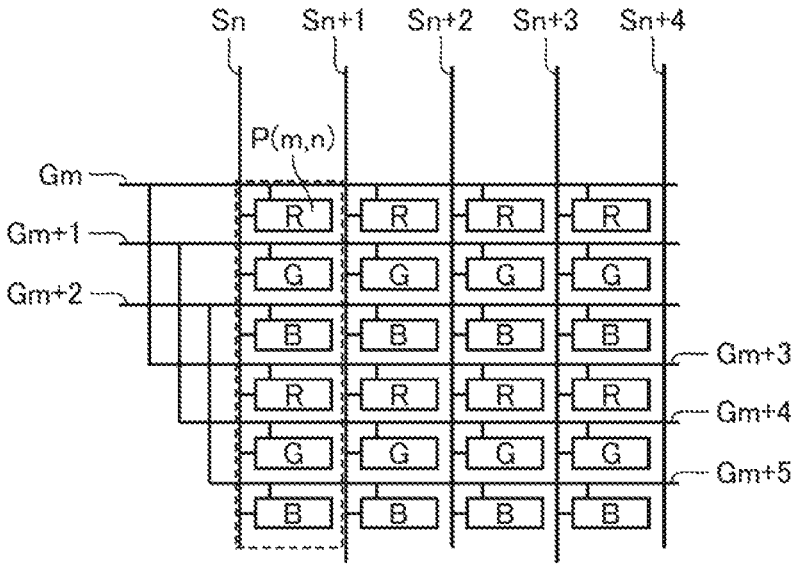
FIG. 7C is an enlarged schematic diagram illustrating a configuration of a low-resolution area in the display device in Embodiment 5.
Figure 7D:
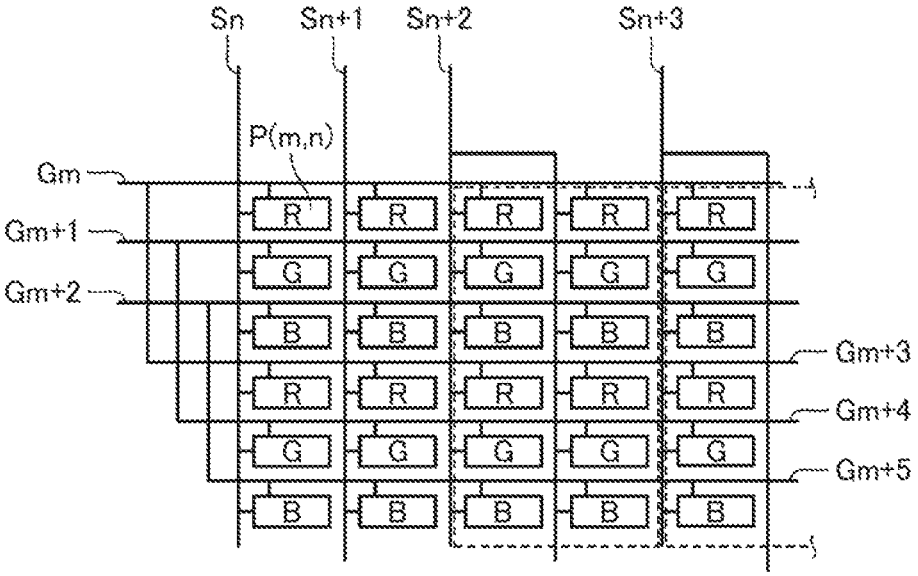
FIG. 7D is an enlarged schematic diagram illustrating a configuration of a low-resolution area in the display device in Embodiment 5.
Figure 8A:
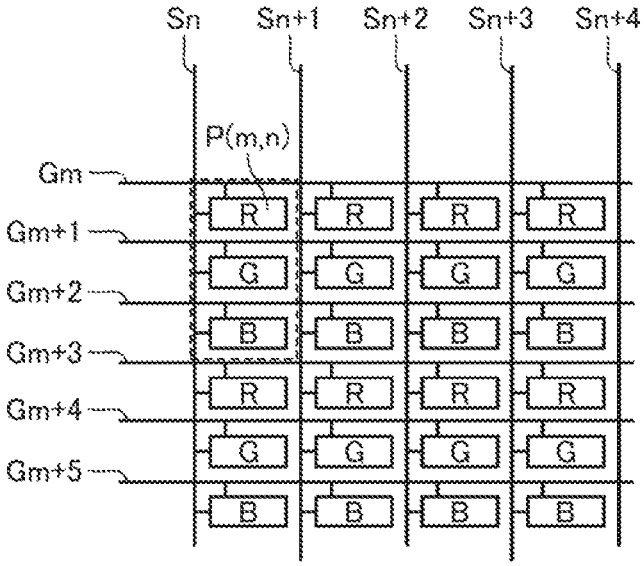
FIG. 8A is an enlarged schematic diagram illustrating a configuration of a high-resolution area in a display device in Embodiment 6.
Figure 8B:
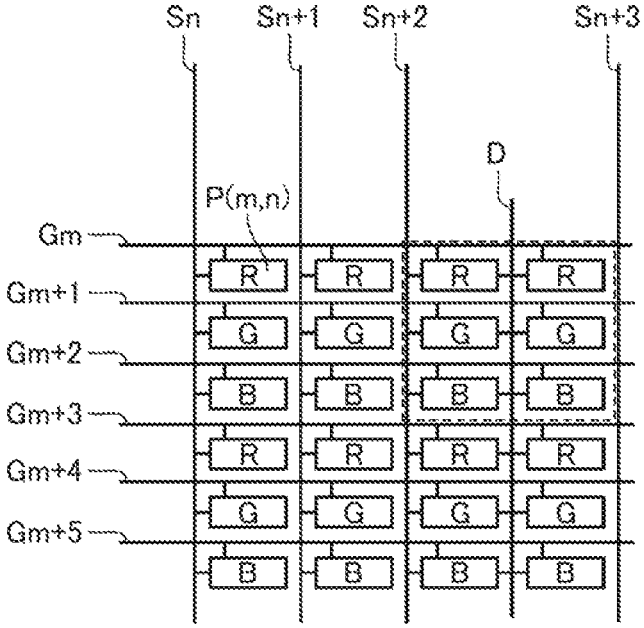
FIG. 8B is an enlarged schematic diagram illustrating a configuration of a low-resolution area in the display device in Embodiment 6.
Figure 8C:
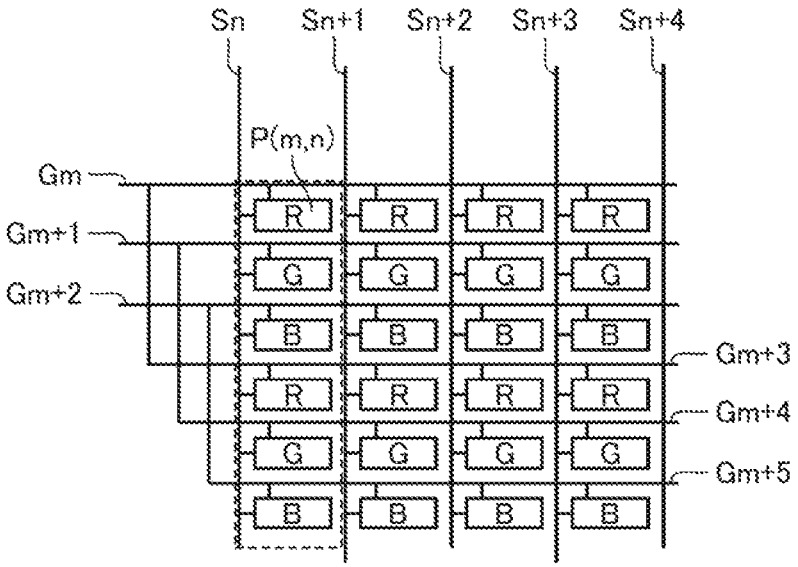
FIG. 8C is an enlarged schematic diagram illustrating a configuration of a low-resolution area in the display device in Embodiment 6.
Figure 8D:
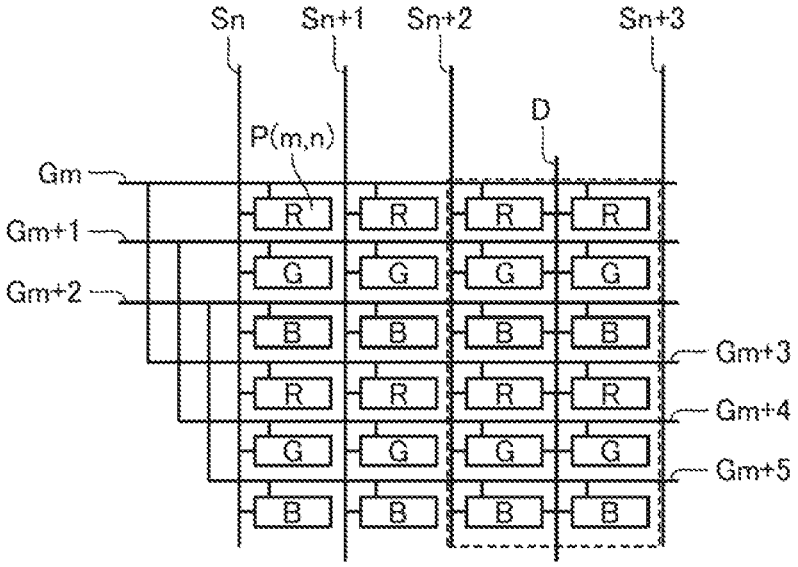
FIG. 8D is an enlarged schematic diagram illustrating a configuration of a low-resolution area in the display device in Embodiment 6.

As illustrated in FIGS. 7A to 7D, in Embodiment 5, pixels of colors of R, G, and 8 are arranged in such a manner that the pixels of the same color are arranged along one gate line G, and the pixels of R, G, and B are periodically arranged along the source line S extending direction. Further, the pair source lines S are composed of adjacent two of the source lines S, as illustrated in FIGS. 7B and 7D.

As illustrated in FIG. 7C, two of the gate lines composing the pair gate lines G are connected to the pixels of the same color.

In this way, the pixels of R, G, and B are arrayed periodically along the source line S extending direction, whereby, as illustrated in FIG. 7A, three pixels arrayed in the vertical direction (the source line extending direction) compose one picture element in the high-resolution area $R_A$. In other words, three of the sub-pixels compose one pixel.

Further, in the area $R_B$, as illustrated in FIG. 7B, the same data signal is supplied to two pixels adjacent in the horizontal direction by the pair source lines S, whereby the six pixels surrounded by a broken line (two picture elements) display the same gray level. In other words, two picture cells each of which is composed of three sub-pixels simultaneously display the same gray level.

Further, in the area $R_C$, as illustrated in FIG. 7C, two pixels of the same color belonging to two picture elements adjacent in the vertical direction are simultaneously selected by the pair gate lines G. This causes two picture elements composed of six pixels surrounded by a broken line to display the same gray level in synchronization. In other words, two picture cells each of which is composed of three sub-pixels display the same gray level.

Further, in the area $R_D$, as illustrated in FIG. 7D, the same data signal is supplied to two pixels adjacent in the horizontal direction by the pair source lines S, whereby two pixels of the same color belonging to two picture elements adjacent in the vertical direction are simultaneously selected by the pair gate lines G. This causes four picture elements composed of twelve pixels surrounded by a broken line to display the same gray level in synchronization. In other words, four picture cells each of which is composed of three sub-pixels display the same gray level.

This configuration allows low-resolution areas to be formed in a part of the display screen, as is the case with the embodiments described above. Besides, since the pixels of R, G, and B are periodically arrayed along the source line extending direction, there is no intersection between the pair source lines, as illustrated in FIG. 7B (as is clear from the comparison with FIG. 2B). This makes it possible to avoid the coupling between the source lines.

Embodiment 6

The following description describes Embodiment 6, while referring to FIGS. 8A to 8D.

The display device according to Embodiment 6 is different from that of embodiment 5 in that in the areas $R_B$ and area $R_D$, lines that are the pair source lines S in Embodiment 5 are one source line S and one dummy line D, respectively. The dummy line D is formed with the same material as that of the source line S and has the same width as that of the source line S. The dummy line D is not connected to the source driver 11 nor with the pixel electrode, thereby being in an electrically floating state. Further, in FIG. 8B, in the area interposed between the dummy line D and the source line Sn+3, no switching element is formed. Still further, in the area $R_B$ and the area $R_D$, pixel electrodes of the two pixels adjacent in the gate line G extending direction are connected to each other. In other words, these two pixels function as one pixel electrode connected to the source line Sn+2.

A connection between the pixel electrodes in the gate line G extending direction can be achieved by patterning the ITO film composing the pixel electrode so as to extend over two pixels continuously, as is the case with the configuration illustrated in FIG. 5B.

This configuration makes it possible to reduce the number of the source lines S connected to the source driver 11 in the low-resolution area. This makes it possible to reduce the loads on the source driver, thereby providing an advantage that there is no concern about insufficient charging.

If it is only intended to reduce the loads on the source driver 11, the dummy line D can be omitted. By providing the dummy line D, however, an advantage can be achieved that the screen door effect (a phenomenon in which wide line pitch causes a mesh-like image to be seen) can be prevented, and at the same time, the manufacturing process uniformity within the display screen can be maintained.

Embodiment 7

Figure 9:
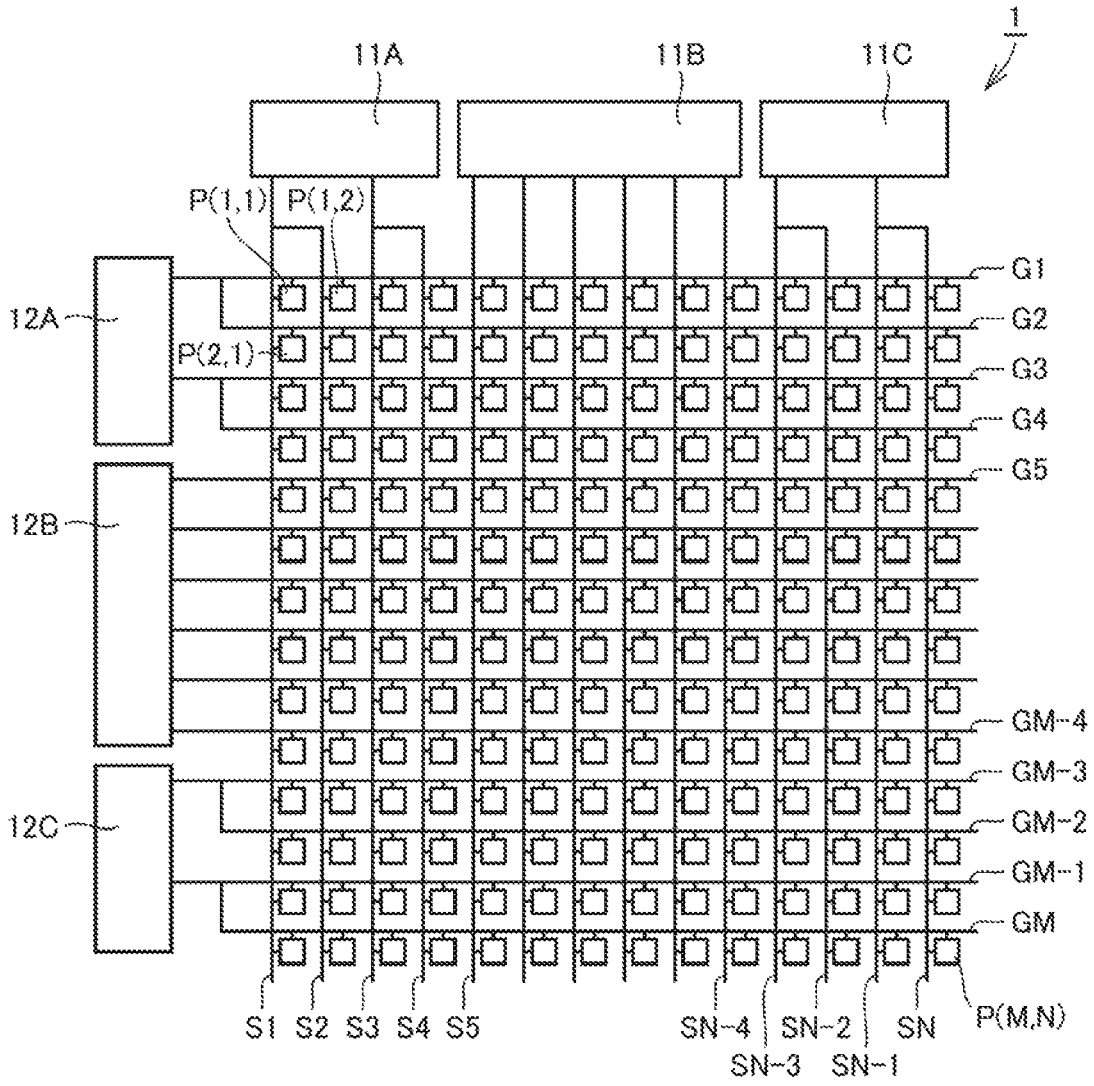
FIG. 9 schematically illustrates a schematic configuration of a display device in Embodiment 7.

The following description describes Embodiment 7, while referring to FIG. 9.

In the display device according to Embodiment 7, as illustrated in FIG. 9, the source driver 11 is formed with three driver circuits 11A to 11C. Besides, the gate driver 12 is formed with three driver circuits 12A to 12C.

The driver circuits 11A and 11C of the source driver 11 are connected to the source lines S in the low-resolution areas. On the other hand, the driver circuit 11B is connected to the source lines S in the high-resolution area. The driver circuits 11A and 11C have greater output capacities as compared with the driver circuit 11B. This is because the number of source lines connected to the driver outputs of the driver circuits 11A and 11C is large, and larges loads are on the source drivers, which tends to make the output waveforms dull. By making the output capabilities of the driver circuits 11A and 11C greater than that of the driver circuit 11B, such waveform dullness can be prevented. Incidentally, the magnitude of the output capability of the driver circuit can be adjusted by increasing/decreasing the bias current of the output buffer (output amplifier) of the driver circuit.

As is the case with the above-described embodiments, the driver circuits 12A and 12C of the gate driver 12 are connected to the gate lines G in the low-resolution area. On the other hand, the driver circuit 12B is connected to the gate lines G in the high-resolution area. The driver circuits 12A and 12C have greater output capabilities than that of the driver circuit 12B.

In this way, by increasing the output capabilities of the driver circuits in accordance with the number of lines (the source lines or the gate lines) connected to the driver outputs in the low-resolution area, the output waveforms can be prevented from becoming dull, which makes it possible to achieve excellent display in the low-resolution area as well.

Modification Example

Exemplary display devices according to the present invention are described above, but the display device of the present invention is not limited to those of the configuration of the above-described embodiments, and can be varied in many ways.

For example, the foregoing embodiments are described with reference to an exemplary configuration in which the display device is formed as a liquid crystal display, but the display device can be formed as an organic EL display or the like.

Besides, two or more of the above-described embodiments can be combined.

The invention claimed is:

1. A display device comprising:

a pixel region that includes a plurality of pixels arranged in matrix;

a plurality of lines connected to the pixels, the lines including a plurality of gate lines that extend in a first direction and a plurality of source lines that extend in a second direction; and a driving unit that includes a gate driver that drives the gate lines, and a source driver that drives the source lines, wherein the pixels have a uniform size, the pixel region includes a low-resolution area in which m pixels adjacent in at least one of the first direction and the second direction display an identical gray level at all times, the m being a natural number equal to or more than 2, in the low-resolution area, a connection of at least either the gate lines or the source lines to the driving unit is in such a manner that m lines are connected to one terminal of the driving unit, the low-resolution area includes an area in which a connection of the gate lines to the driving unit is in such a manner that m lines are connected to one terminal of the driving unit, and a length of a period while the gate driver outputs a selection signal to the terminal to which the m gate lines are connected is m times a length of a period while the gate driver outputs the selection signal to a terminal to which one gate line is connected.

2. The display device according to claim 1, wherein the pixels correspond to a plurality of colors, respectively, and in the low-resolution area, at least a connection of the source lines is in such a manner that m lines connected to the pixels of the same colors are connected to one terminal of the driving unit.

3. The display device according to claim 2, wherein the pixels correspond to n colors, the n being a natural number equal to or more than 3, in the high-resolution area, the pixels of the n colors are periodically arranged along a direction in which the gate lines extend, and in the low-resolution area, the pixels of the n colors are arranged periodically by m pixels for each color along the direction in which the gate lines extend.

4. The display device according to claim 1, wherein the low-resolution area includes a region where a connection of the source lines and the gate lines to the driving unit is in such a manner that m source lines are connected to one terminal of the driving unit, and one gate lines is connected to one terminal of the driving unit, and in the region, the pixels connected to two or more adjacent ones of the gate lines are connected with each other.

5. The display device according to claim 1, wherein the pixels correspond to n colors, the n being a natural number equal to or more than 3, the pixels of the n colors are periodically arranged along a direction in which the source lines extend, and the low-resolution area includes an area where a connection of the source lines to the driving unit is in such a manner that m lines are connected to one terminal of the driving unit.

6. The display device according to claim 1, further comprising:

switching elements that are connected to the gate lines and the source lines and drive the pixels, wherein, in the low-resolution area, a connection of the pixels and the switching elements is in such a manner that m pixels that are adjacent along a direction in which the gate lines extend are connected with each other, and are driven by one switching element.

7. The display device according to claim 6 further comprising:

between the m pixels, a dummy line that is formed in parallel with the source lines, and is not connected to the driving unit.

8. The display device according to claim 1, wherein the source driver includes a plurality of driver circuits that have different output capabilities, and among the driver circuits, the driver circuit that drives the pixels in the low-resolution area has a higher output capability than the other driver circuits.

9. A display device comprising:

a pixel region that includes a plurality of pixels arranged in matrix;

a plurality of lines connected to the pixels, the lines including a plurality of gate lines that extend in a first direction and a plurality of source lines that extend in a second direction; and a driving unit that includes a gate driver that drives the gate lines, and a source driver that drives the source lines, wherein the pixels have a uniform size, the pixel region includes a low-resolution area in which m pixels adjacent in at least one of the first direction and the second direction display an identical gray level at all times, the m being a natural number equal to or more than 2, in the low-resolution area, a connection of at least either the gate lines or the source lines to the driving unit is in such a manner that m lines are connected to one terminal of the driving unit, the low-resolution area includes a region where a connection of the source lines and the gate lines to the driving unit is in such a manner that m source lines are connected to one terminal of the driving unit, and one gate lines is connected to one terminal of the driving unit, and in the region, the pixels connected to two or more adjacent ones of the gate lines are connected with each other.

10. A display device comprising:

a pixel region that includes a plurality of pixels arranged in matrix;

a plurality of lines connected to the pixels, the lines including a plurality of gate lines that extend in a first direction and a plurality of source lines that extend in a second direction;

a driving unit that includes a gate driver that drives the gate lines, and a source driver that drives the source lines; and switching elements that are connected to the gate lines and the source lines and drive the pixels, wherein the pixels have a uniform size, the pixel region includes a low-resolution area in which m pixels adjacent in at least one of the first direction and the second direction display an identical gray level at all times, the m being a natural number equal to or more than 2, in the low-resolution area, a connection of the pixels and the switching elements is in such a manner that m pixels that are adjacent along a direction in which the gate lines extend are connected with each other, and are driven by one switching element, and the display device further comprises a dummy line that is formed between the m pixels in parallel with the source lines and is not connected to the driving unit.

* * * * *